United States Patent [19]

Fleming et al.

[11] 4,439,759

[45] Mar. 27, 1984

[54] TERMINAL INDEPENDENT COLOR MEMORY FOR A DIGITAL IMAGE DISPLAY SYSTEM

[75] Inventors: James R. Fleming, Indianapolis, Ind.; William A. Frezza, North Brunswick; Gerald S. Soloway, Holmdel, both of N.J.

[73] Assignee: Bell Telephone Laboratories, Incorporated, Murray Hill, N.J.

[21] Appl. No.: 265,195

[22] Filed: May 19, 1981

[51] Int. Cl.[3] ..... G09G 1/16

[52] U.S. Cl. ..... 340/703; 340/723; 340/750

[58] Field of Search ..... 340/703, 701, 717, 747, 340/750, 726, 709, 723

[56] References Cited

U.S. PATENT DOCUMENTS 3,422,419 1/1969 Mathews et al. ..... 340/736
4,091,374 5/1978 Müller et al. ..... 340/717
4,233,601 11/1980 Hankins et al. ..... 340/703
4,342,029 7/1982 Hofmanis et al. ..... 340/703

*Primary Examiner*—Marshall M. Curtis
*Attorney, Agent, or Firm*—H. L. Newman

[57] ABSTRACT

The present terminal independent color memory for a digital image display system provides for inter-system compatability, color display systems generally having varying modes of access to color memories, varying color memory capacities, and features such as blinking implemented in varying ways. The data processor (1) of the present system may access color memory (6*a*) of video controller (6) or color values stored in permanent memory (9) or random access memory (10), responsive to the same command language. The present data processor (1) is also capable of entering color data values comprising color hues and gray levels into color memory for use in a terminal independent manner. Multiple process chained blinking from a particular color to a particular color is also provided by the present processor, the several processes in time-delayed relationship to one another.

10 Claims, 14 Drawing Figures

| 704 ADDRESS | 701 R | 702 G | 703 B |
|---|---|---|---|
| 0 0 0 0 | 0 0 0 | 0 0 0 | 0 0 0 |
| 0 0 0 1 | 0 0 1 | 0 0 1 | 0 0 1 |
| 0 0 1 0 | 0 1 0 | 0 1 0 | 0 1 0 |
| 0 0 1 1 | 0 1 1 | 0 1 1 | 0 1 1 |
| 0 1 0 0 | 1 0 0 | 1 0 0 | 1 0 0 |
| 0 1 0 1 | 1 0 1 | 1 0 1 | 1 0 1 |
| 0 1 1 0 | 1 1 0 | 1 1 0 | 1 1 0 |
| 0 1 1 1 | 1 1 1 | 1 1 1 | 1 1 1 |
| 1 0 0 0 | 0 0 0 | 0 0 0 | 1 1 1 |
| 1 0 0 1 | 0 0 1 | 0 0 1 | 1 1 1 |
| 1 0 1 0 | 0 1 0 | 0 1 0 | 1 1 1 |
| 1 0 1 1 | 0 1 1 | 0 1 1 | 1 1 1 |
| 1 1 0 0 | 1 0 0 | 1 0 0 | 0 0 0 |
| 1 1 0 1 | 1 0 1 | 1 0 1 | 0 0 0 |
| 1 1 1 0 | 1 1 0 | 1 1 0 | 0 0 0 |
| 1 1 1 1 | 1 1 1 | 1 1 1 | 1 1 1 |

BLACK ← 706 GREY SCALE → WHITE

WHITE ← 707 HUES →

* FPIAL - FIRST PROCESS IN ACTIVE LIST

TERMINAL INDEPENDENT COLOR MEMORY FOR A DIGITAL IMAGE DISPLAY SYSTEM

BACKGROUND OF THE INVETNION

1. Technical Field

This invention relates to digital image display systems and, more particularly, to a terminal independent color memory for such systems.

2. Description of the Prior Art

Methods and apparatus for providing color digital images on video display screens are well known. A problem, however, has arisen in that compatability among digital display systems has been made difficult by the great variety of methods and apparatus for providing the color images. For example, the Picture Description Instructions PDI for the Telidon Videotex System, CRC Technical Note No. 696-E, developed by the Canadian Department of Communications describes a specific color value selection method: a direct selection of data values for the primary colors—red, green and blue. The Prestel videotex customer terminal developed by the British Post Office and the Antiope terminal developed by the French CCETT employ a technique for specifying both a foreground and a background color by indexing a permanent read-only color memory.

In the art of color computer graphics, the terminal manufacturers generally employ a color look-up table called a color map indexed by a binary number. The application of a color map expands the repertory of available colors for display. In particular, the Tektronix 4027 terminal is capable of providing 8 colors for direct use from the 64 possible color values that may be loaded into its color map. Other features such as blinking may be provided by such terminals; however, the various methods and apparatus for providing such features are similarly incompatible.

With the advent of videotex, also known as viewdata, and teletext services wherein a customer is able to access a remote host computer and associated data base with a digital image display terminal, there has arisen a need to solve the above-described problems from employing incompatible terminals. There remains a requirement for a terminal-independent color memory for a digital image display system.

SUMMARY OF THE INVENTION

The above-stated problems and related problems of incompatability among digital image display systems are solved by the principles of the present terminal independent color memory. Processing means are provided for accessing color data in a terminal independent manner, regardless of the size of color memory or its permanent or semi-permanent nature. In accordance with the present invention, the known modes of color access are incorporated into the present algorithm for selecting a particular mode of color memory access, for setting a particular color in a color map memory table or for setting foreground or background in-use drawing color. These in-use drawing colors may be applied by subsequently received text and graphics drawing commands. In a system having a permanent color memory, the algorithm selects the closest color to the desired color hue from the permanent color selection table.

An algorithm for loading the present color map memory selects a gray scale equally spaced between black and white and hue data values equally spaced about a hue circle wherein the primary colors are located in 120 degree relationship. In this manner, a host computer is able upon initialization of the present terminal independent color memory to predict the configuration of a particular color map memory table and the color composition of a digital image or frame of information for display.

An algorithm for providing color blinking by means of a linked list of multiple processes is provided. The on and off intervals of blink-from colors and blink-to colors may be specified. In addition, the delay between processes is selectable. Simple animation is possible with the present technique. For example, a ball may appear to bounce across an image, a river may appear to flow or stars may appear to twinkle.

BRIEF DESCRIPTION OF THE DRAWINGS

FIG. 8 is a depiction of the contents of a memory block associated with a particular blink process;

FIG. 9 comprises blink process tables indicating the logical connection of linked lists of active and free process blocks as depicted in FIG. 8;

FIG. 10 is an actual depiction of an active blink process table comprising a plurality of process blocks as depicted in FIG. 8;

FIG. 11 is a flowchart diagram of an algorithm for providing multiple process color blinking;

FIG. 12 is a flowchart diagram of an algorithm for adding a new process to the active blink process table of FIG. 10;

FIG. 13 is an exemplary timing diagram and color tables for a color blink comprising three processes; and FIG. 14 is an exemplary blink process table similar to that depicted in FIG. 9 whose process memory block entry values are shown relative to a particular point in the timing diagram of FIG. 13.

DETAILED DESCRIPTION

Figure 1:
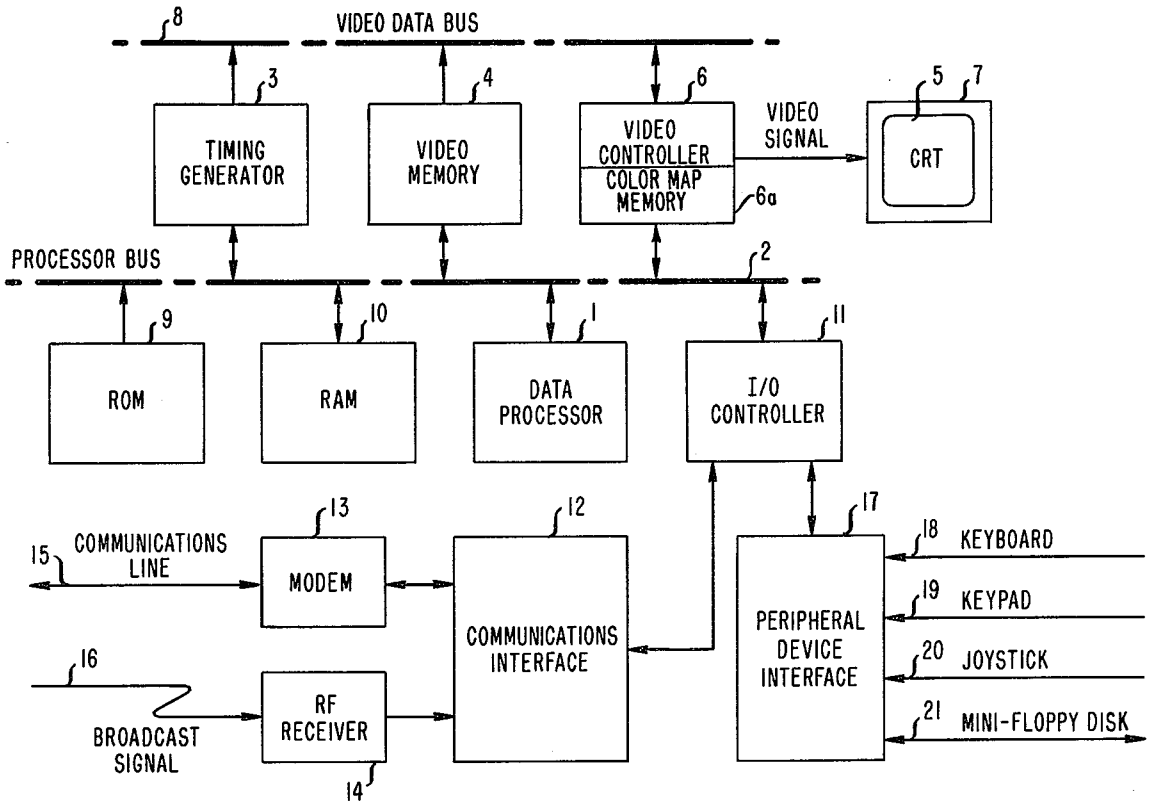
FIG. 1 is a general block diagram of a digital image display system which may employ the principles of the present invention, the system being exemplary of arrangements for color processing.

Referring more particularly to FIG. 1, there is shown a general block diagram of a digital image display system employing the principles of the present invention. The digital image display system comprises a data processor 1 having bidirectional access to a processor data bus 2. A separate timing generator 3 may provide the clock signals required on the processor data bus 2; however, in some systems, the timing generator capability is provided by data processor 1. The timing generator 3 may also provide the timing signals on a video data bus 8 for use by video memory 4, and by a video controller 6. The video controller 6 operates video display 7 responsive to the picture element data received over the video data bus 8. The picture element comprises a binary index for selecting color data values from color map memory 6*a*. Complete digital images or frames 5 of picture element information are sequentially displayed in color by video display 7.

Data processor 1 may be a microprocessor comprising program or read-only memory 9 and scratch pad or random access memory 10. In a viewdata or teletext terminal which may be located in a residential home, it is desirable that data processor 1 be as small as possible; accordingly, a microprocessor may be assumed.

Data processor 1 responds to user input from a keyboard 18, keypad 19, joystick 20, floppy disc 21, light pen or other data input device known in the art through peripheral device interface 17. In accordance with known technology, data processor 1 may program the video memory 4, the timing generator 3 and the video controller 6 to the proper modes of operation which will allow maximum flexibility in remotely reconfiguring the terminal operating characteristics.

In its application with a viewdata or teletext terminal, the data processor 1 may also respond to input provided from a remote or centralized data base such as one located at a television broadcast station or a provider of viewdata services. Such inputs are provided through communications interface 12. In the case of teletext services, a TV broadcast signal 16 is received at receiver 14 and provided to interface 12. In the case of viewdata services, data is provided over a communications line 15 through a data modulator/demodulator 13 to interface 12. Input/output controller 11 under user control provides selectable access to the various data input and output arrangements.

Processor data bus 2 is a bi-directional conduit through which the data processor 1 controls the video memory 4, the timing generator 3 and the video controller 6. Several bus structures may be adapted for use in the present invention. One example is the INTEL Corp. Multibus. Whichever specific bus structure is chosen, the bus generally comprises address capability, a data path and control lines which may include interrupt, reset, clock (for synchronous use), wait (for asynchronous use), and bus request lines.

The timing generator 3 may comprise a chain of programmable logic circuits, digital dividers and counters for providing required timing signal outputs. For operation of the video data bus 8, a number of different timing signals are required. Horizontal and vertical drive signals are provided in accordance with horizontal and field rates respectively. A dot clock signal is provided at the dot frequency (picture element or pel rate) of the system. An odd/even field signal indicates if the odd or even field is to be displayed in an interlaced system. A composite blanking signal indicates if video is being displayed or if vertical or horizontal retrace is occurring. Also, a group clock signal or other signals may be provided. The group clock signal indicates when to access data for a new group of picture element data from memory. For example, picture element data in video memory having a slow access time may be serially provided in groups of 4, 8 or 16 picture elements. On the other hand, a parallel data transmission scheme is possible, potentially increasing the requirements for leads of video data bus 8.

Video controller 6 accepts digital image information from the video data bus 8, pel-by-pel, and converts the digital information, if necessary, to analog form for presentation on video display 7. The video controller comprises three components: (1) color map memory 6*a*; (2) digital to analog conversion and sample and hold circuits (not shown), if required by video display 7; and (3) a standard composite video encoder (not shown), for example, for providing NTSC standard video or red, green, blue (RGB) outputs.

Color map memory 6*a* comprises a color map memory table in random access memory indexed by a binary number component of pel data entering the video controller 6 by way of video data bus 8. For example, if four bits of color data are compiled per picture element, 16 color choices are directly accessable from color map memory table 6*a*. Each color data value indexed may comprise, for example, 12 bits of RGB data, the domain of possible data values in this case being 4096 possible values. The color map memory 6*a* may be loaded and updated from the large repertory of possible choices by the data processor 1 under local or remote control.

The application of color map memory 6*a* provides flexibility and greater color capacity than other color memory means. However, other color memory means are known in the art. Permanent memory 9 of data processor 1 may contain a directly accessible color table. Selections of color data values from permanent memory 9 are transferred to color map memory 6*a* for subsequent use. Also, random access or semi-permanent memory 10 of data processor 1 may contain a color memory, color data similarly being transferrable to color map memory 6*a*. Various modes of access to color memory, wherever located, in a digital image display system, are employed by the providers of viewdata and teletext services. Means for providing terminal independent color memory will be subsequently discussed in connection with FIGS. 3–14.

The color memory RGB output may be provided to three separate digital to analog converters, one for each primary color. In accordance with techniques generally known in the art, the RGB output may enter a monitor video display 7 directly, may be converted to a composite video signal for input to a monitor video display 7 or modulated to a particular RF frequency for input through the antenna lead-in of a television set display 7.

Video display 7, as previously discussed, may either be a monitor or a television set. In deference to the previous discussion, it may additionally comprise other forms of video display known in the art including a video projection system, a liquid crystal display or an LED display. The list is not intended to be inclusive and, if another standard format of input video signal is required, the principles of the present invention assume the capability of video controller 6 for providing such a standard video signal.

The video memory 4 comprises random access memory for storage of video picture element information for display. In particular, video memory 4 generally accepts input from the data processor 1 in the form of an image comprising digitized picture element information. The video memory 4 stores the information until rearrangement of data occurs and periodically passes the pel information over video data bus 8 to the video controller 6 on command of data processor 1. As previously indicated, the pel data comprises binary data employed to index a particular color entry in color map memory 6a.

The video data bus 8 connects the timing generator 3 and the video memory 4 to the video controller 6. It comprises the following types of leads: data leads for picture element information which is used for indexing into the color map memory 6a of video controller 6, and timing leads for providing video timing and control. The six timing and control leads include the previously mentioned horizontal and vertical drive signals, the dot clock, the field signal, the composite blanking signal and the group clock signal.

Figure 2:
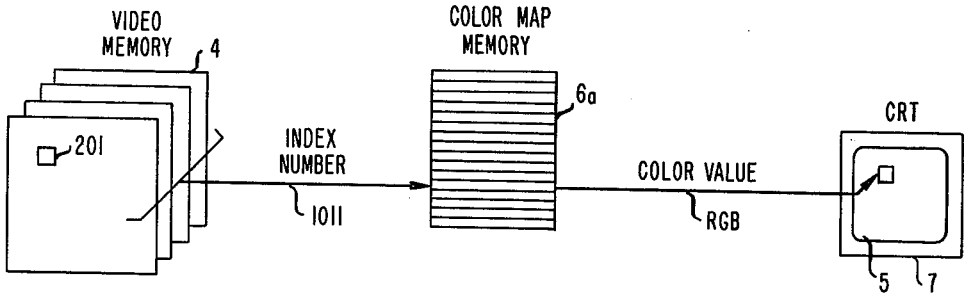
FIG. 2 is an operational diagram of the process for selecting a color data value from a color map memory table for display of particular picture element data.

Referring more particularly to FIG. 2, an operational diagram is shown which depicts how a binary number component of picture element data stored in a planar bit memory 4 indexes color map memory 6a so that primary color data values for a video signal are provided for video display. Similar reference characters have been employed in FIGS. 2 through 14 wherever possible and in the subsequent discussions wherever possible. In addition, the first numeral of reference characters employed in FIGS. 2 through 14 relates to the location where the referenced element first appears.

In the depicted example a color map memory table of 16 colors is shown. The capacity or domain of the color map memory table may comprise, for example, four bits each of red, green and blue data. The total twelve bit capacity then relates to 4096 possible colors. Accordingly, each of the 16 tabular values indexed may comprise 12 bits of RGB data.

In the depicted example, picture element data 201 comprises, in addition to coordinate data of the location in a particular image or frame 5 for display, the binary index value representing the color that picture element 201 is to be. Binary index value 1011 representing the twelfth entry in the color map memory table may, for example, represent color data value 0011 1111 0000; 0011 being red data; 1111 being green data, and 0000 being blue data. The RGB data value, as previously discussed, illuminates the particular coordinate location in the particular in-use color in frame 5 of display 7.

Upon command of a host computer remotely provided by a teletext or videotex service provider, the color map memory table of 16 colors may be specifically loaded in combination with video processor 1 and the subsequently described software algorithms locally stored in program memory 9. Under control of local keyboard input, the data processor 1 may also specifically load the color map memory table. In accordance with the present invention, either the host computer or the local user may directly load colors into color map memory 6a from permanent memory 9 or from a semi-permanent memory 10 with color data values for use.

Figure 3:
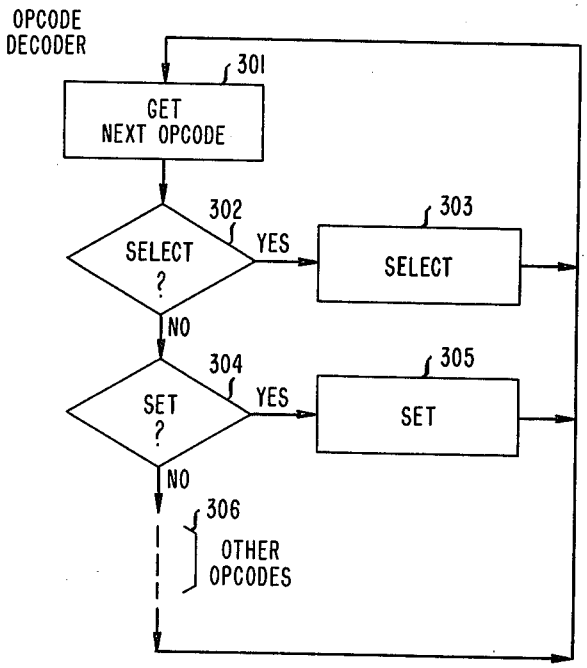
FIGS. 3, 4, and 5 are flow diagrams of a method for accessing color data values for display regardless of the mode of access employed by a particular digital image display system in accordance with the present invention.
Figure 4:
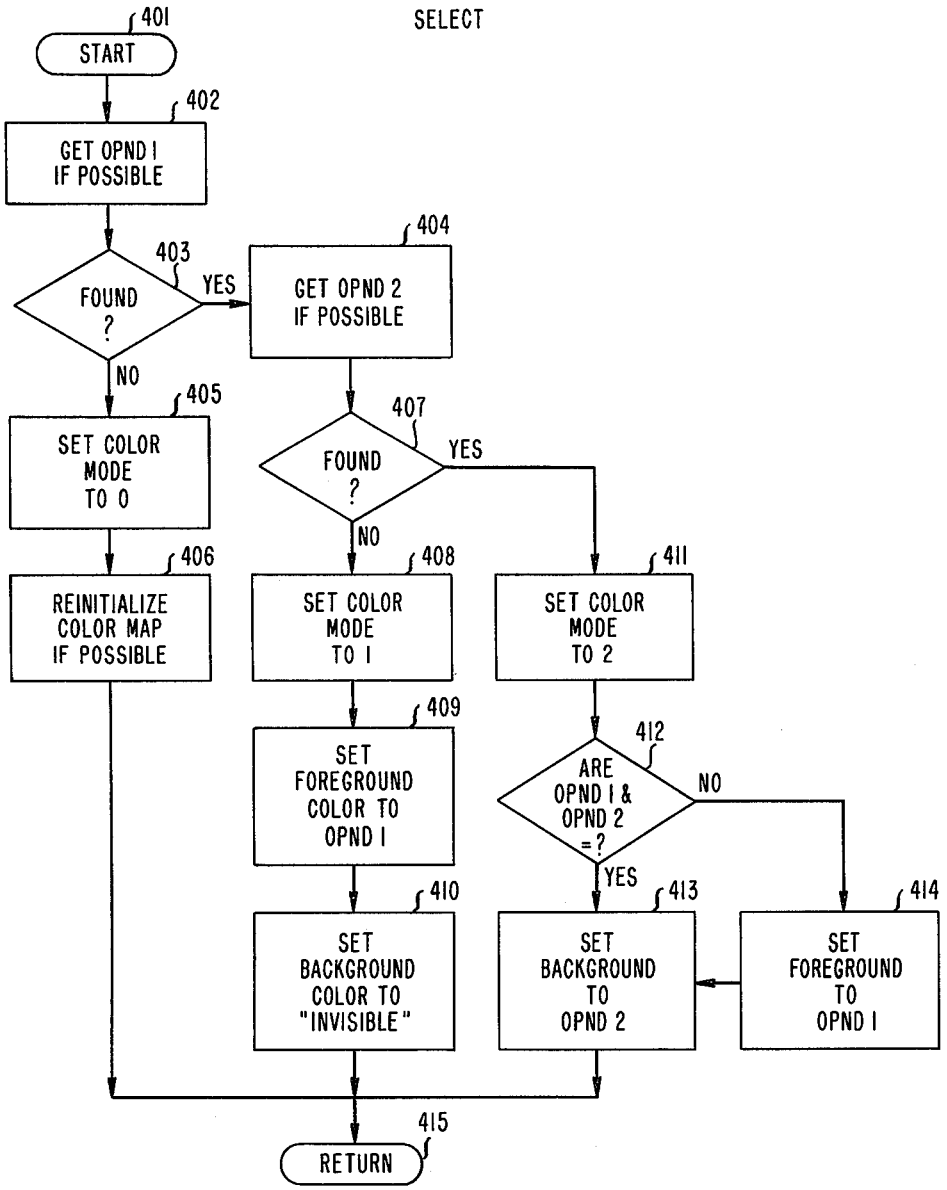
Figure 5:
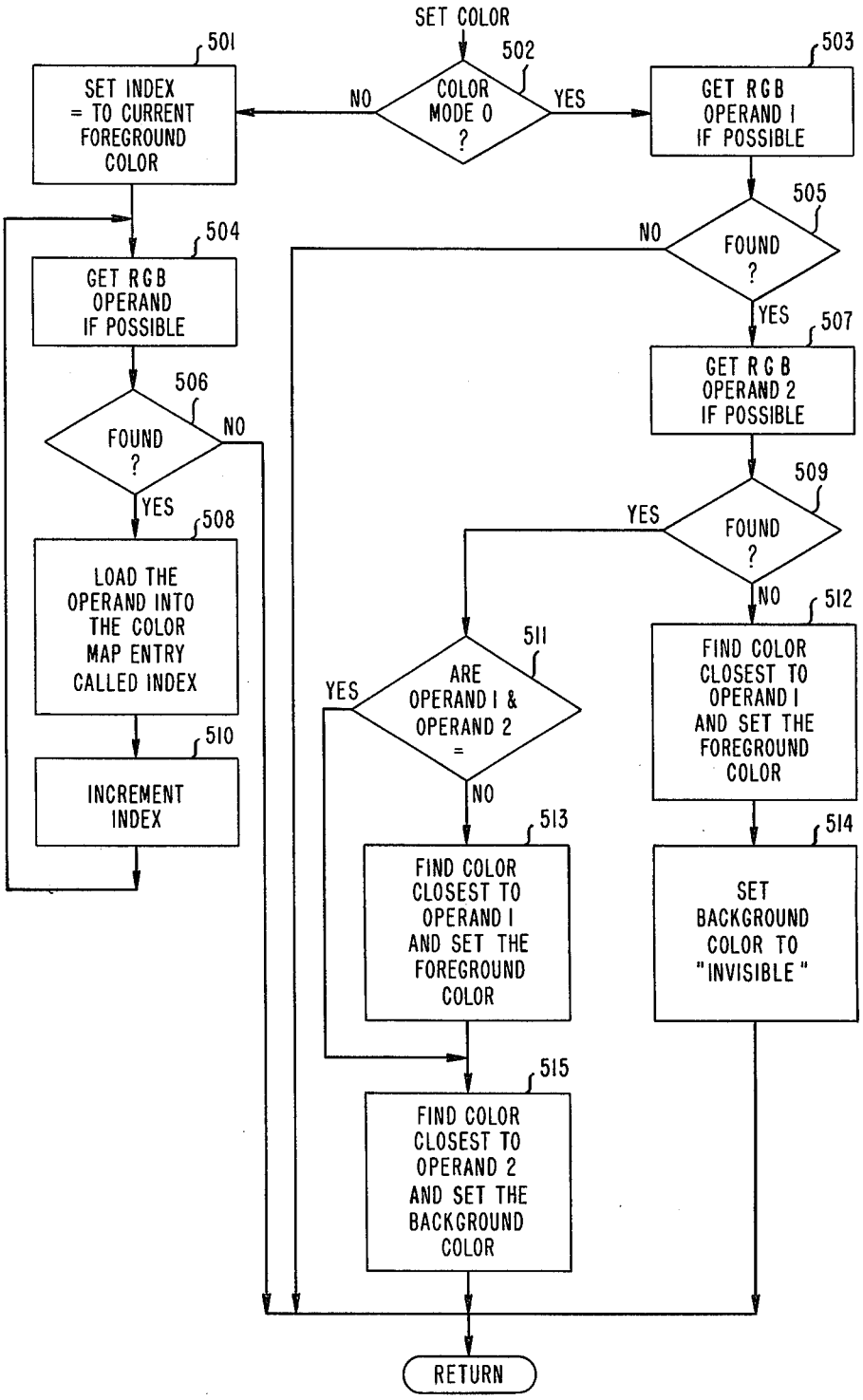

Referring to FIGS. 3, 4, and 5, flow diagrams are depicted of a method or algorithm for accessing color memory 6a in a terminal independent manner and for setting the foreground and background in-use color if possible. FIG. 3 particularly represents a command decoding process. If a first particular command is found, then the flow diagram of FIG. 4 is performed within data processor 1. If a second particular command is found, then the flow diagram of FIG. 5 is preformed. Other commands or operation codes (opcodes) are interpreted by the command decoder algorithm depicted in FIG. 3. These other commands may include commands to perform the subsequently described blinking process or other text or graphic drawing processes. The commands will be hereinafter referred to as opcodes.

Referring particularly to FIG. 3, the data processor is instructed in box 301 of the opcode decoder algorithm to attempt to locate the next opcode. The opcode may be remotely received from a host computer or locally received through the peripheral device interface 17. At decision box 302, the data processor 1 determines if the opcode entered is one for selecting a mode of color memory access. At box 303, transfer is effected to the algorithm for the mode selection process shown in FIG. 4 if there is a match. If there is not a match, the data processor determines at decision box 304 whether the opcode entered is one for setting a color data value. At box 305, transfer is effected to the algorithm for the color setting process shown in FIG. 5 if there is a match. In a similar manner, the entered opcode may be compared with other valid opcodes 306 and the entire opcode decoding process repeated.

Referring to FIG. 4, an algorithm for selecting a mode from a plurality of modes of color memory access and for setting foreground and background in-use colors for two of these modes is shown in flowchart form. Having transferred control to box 401 of the algorithm of FIG. 4 in the operation of the flowchart of FIG. 3, the data processor 1 now interprets the operands or data following the opcode. In general, it is presumed that an opcode will always be followed by a sequence of operands or data entrys or a new opcode. Accordingly, in the process depicted in FIG. 4, the data operands are interpreted and, as a result, the mode of access and the background and foreground color set if possible.

In particular at box 402, the first data operand is recovered if possible. If a box 403 an operand is located, another attempt is made at box 404 to locate a second operand. If at box 407 a second operand is found, the color mode of access is set at box 411 to mode 2. In other words, the color mode is determined by the number of operands following the opcode for selecting the mode of access. Accordingly, when no operands are found, the color mode is set at box 405 to mode 0. If one operand is found, the color mode is set at box 408 to mode 1.

In color mode 0, besides setting the color mode, it may be necessary in systems employing random access color memory 10 to reinitialize color map memory 6a to a default set of color data values. Accordingly block 406 suggests this activity if it may be performed. Color mode 0 of the present terminal independent color memory is adapted for use in digital image display systems employing a direct color selection process either from permanent or semi-permanent color memory.

After setting the color modes to 1 or 2 at blocks 408 or 411 respectively, the foreground and background in-use drawing colors are set. If foreground and background colors may be set in color mode 0, the subsequently described algorithm of FIG. 5 performs this feature. In color mode 1, only picture element data of the actual character in video memory 4 is drawn in the current in-use foreground color without illuminating adjoining picture element data in a background color. In color mode 2, text characters will be drawn in the in-use foreground color over the in-use background color. In other words, a character may fill a rectangular field on display 7. The actual character is illuminated in foreground color as in color mode 1, and the rectangular field surrounding the actual character is filled with the current in-use background color.

Therefore, in color mode 1, the foreground color is set at box 409 to the value of the first operand. At box 410, the background color is set to a data value representing "invisible" or no color. In color mode 2 the data processor compares the first and second operands entered. If the two operands are equal, then it is assumed that it is desired to only change the background in-use color and not the foreground color. Otherwise, the foreground color is set at box 414 and the background color is set at box 413 to the first and second operands respectively. Control is returned at box 415 to the opcode decoder program upon the completion of the color access algorithm.

Referring to FIG. 5, an algorithm in flowchart form is depicted (1) in color modes 1 or 2, for setting the color data values in color map memory 6*a* in a terminal independent manner or (2) in color mode 0, for setting foreground and background colors. At decision box 502, the data processor determines if color mode 0 has been previously entered. It is assumed that, before the opcode for setting a color data value is entered, the select color access mode opcode has been read and acted upon in accordance with the flowcharts of FIGS. 3 and 4.

If the color access mode at decision box 502 is 0, then the first operand is located if possible at box 503. If the operand is located at decision box 505 then a second operand is located if possible at box 507.

If a second operand was not successfully located at decision box 509, then the foreground color and the background color will be modified at boxes 512 and 514 respectively. At box 512, the foreground color is set to the index of the closest match of the first operand and a color value from the color map memory table 6*a*. At box 514, the background color is set to an "invisible" color. "Invisible" is intended to describe the process of depositing pel values in video memory 4 only at the character or graphics drawing command locations corresponding to the foreground of the resulting image and not over-writing those corresponding to the background.

If a second operand has been successfully located at decision box 509 then a check is made at decision box 511 to see if both operands are equal. If the first operand and second operand are equal, then by convention only the background color is set at box 515. If the two operands are not equal at decision box 511 then the foreground color is set at box 513 and the background color is subsequently set at box 515. As in the case of a single operand, the foreground color and the background color are set to the index of the closest matched color in the color map memory table 6*a*.

If the color mode was not 0 at decision box 502 then the color map memory table 6*a* will be loaded with colors specified by subsequent operands. The current in use foreground color index will indicate the first potential color map memory table entry to be changed. INDEX is set to the current in-use foreground color index at box 501. An attempt is made to get an RGB operand at box 504 if possible. If the operand is found at decision box 506, then the RGB operand is loaded into the color map memory table 6*a* at the location determined by INDEX. The INDEX is then incremented at box 510. The sequence of boxes 504, 506, 508, and 510 is repeated as long as operands are available.

Figures 6, 7:
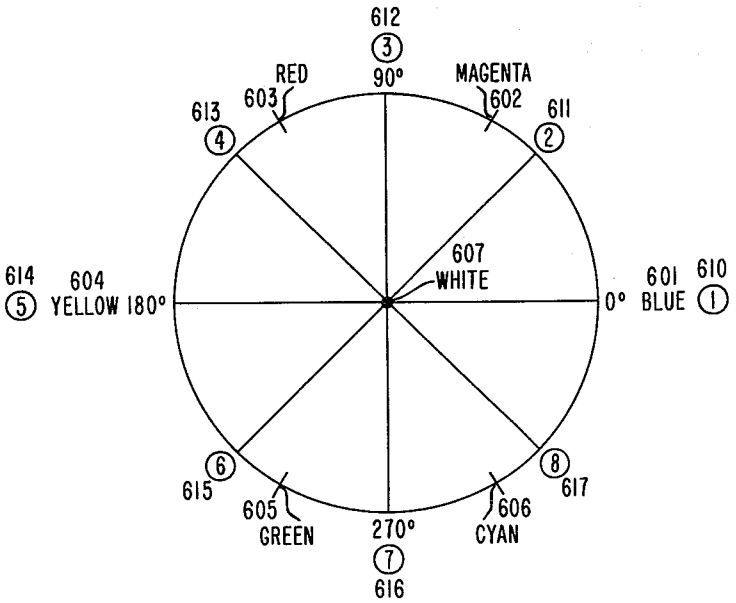
FIG. 6 is a representation of a color hue circle wherein the primary colors—red, green and blue—are located at 120 degrees, 240 degrees and 360 degrees respectively.
FIG. 7 is an exemplary table of color data values selected in accordance with a method for initializing a color map memory table in a terminal independent manner in accordance with the present invention.

Referring to FIG. 6, a color hue circle is shown wherein the primary colors—red, green, and blue—are located at 120 degrees, 240 degrees, and 360 degrees.

Upon the operation of the box 406 of FIG. 4 and on other occasions in the operation of a digital image display system, for example, an explicit resetting operation, it is appropriate to initialize or establish color map memory table 6*a* regardless of the number of possible entries and in a predictable fashion. Accordingly, a method is provided whereby one half of the color map memory is filled with a gray scale whose values are equally spaced between black and white and the other half of color map memory 6*a* is filled with a color hue scale whose values are spaced about a hue circle of 360 degrees.

In particular, if the number of bits of a binary number index into a particular color map 6*a* is defined as N, then the number of entries in the color map is $2^N$. Then the quantity $2^N/2$ of entires comprise gray scale values and the quantity $2^N/2$ of entires comprise color hue values.

The capacity or domain of the color map memory table 6*a* may be defined as comprising M bits of data. Then, the quantity M/3 bits of data may represent data for each primary color—red, green, and blue. In general, the relationship between M and N may be maintained that M be greater than or equal to three times the quantity N-1.

By way of example, if a particular color map memory is indexed by a 4 bit binary index value, then 8 gray scale levels and 8 hues are loaded upon request into color map memory table 6*a*. The quantity M then should be greater than or equal to 9:3 bits each of red, green, and blue data.

The gray scale is found particularly as a binary number in this example between 000 000 000 and 111 111 111 and generally is represented by the binary result of the equation: $P_1=k/(I-1)$ where I represents the decimal number of gray scale levels, generally $2^N/2$, k, a quantity between 0 . . . I-1, is the particular entry in the map desired, and $P_1$ is the binary result for a primary color—red, green, and blue. It is most convenient if, in the operation of data processor 1, the result is normalized and rounded to the nearest M/3 bits. The value for all the primary colors is set equal to this last.

Referring briefly to FIG. 7, an exemplary color map memory table is shown. In accordance with the above method, the first eight values are shown initialized to gray scale levels in a gray scale 706 between 000 000 000 at address 704 with the binary index value 0000 and value 111 111 111 at address 704 with the binary index value 0111.

To provide the color hue values, data processor 1 must first calculate the angle of a desired color hue h. If n entries are required then the result of the caluclation (j−1) times 360 degrees divided by n (wherein j is an integer between 1 and n) provides the angle of h. In FIG. 6, if eight hue data values are desired then by way of example, color data values are desired for 45 degrees, at location 611, 90 degrees at location 612, 135 degrees at location 613, and so on about the color hue circle.

In general, the data processor must particularly locate the location of the closest primary color angle to the desired angle, the next closest primary color and the furthest primary color from the desired angle. In particular, for the example of color value 611 at 45 degrees, then the primary color blue is the closest primary color at location 601 or 360 degrees. This result may be appropriately established in temporary memory as variable $P_1$. The next closest primary color to the exemplary desired color hue is red at location 603 or 120 degrees. This result may be appropriately established in temporary memory as variable $P_2$. The furthest primary color from the exemplary desired color hue is green at location 605 or 240 degrees. This result may be established in temporary memory as variable $P_3$.

The results $P_1$, $P_2$, and $P_3$, of this calculation are then employed generally to establish the color data values for the primary colors—red, green and blue. As it is known that $P_1$ is blue in the particular example under discussion, the blue data value in binary form is set in color map memory as all 1 bits. As it is known that $P_3$ is green, the green data value is set in color map memory as all 0 bits.

In the case of $P_2$, data processor 1 is instructed to calculate the binary result of the equation:

$$P_2 = \left| \frac{\sphericalangle h - \sphericalangle P_1}{60^\circ} \right|$$

As it is known that $P_2$ is red, the red data value is set in color map memory to the binary result of the above calculation. As with the gray level calculation, it is generally appropriate that the result be rounded to the nearest M/3 data bits in length after normalizing the result.

Referring again to FIG. 7, the color hue data values are entered in address locations 1000 to 1111 in the depicted exemplary color map memory table. In particular, the above exemplary calculation for a hue at 45 degrees on the hue circle of FIG. 6 is located at address 1001. As previously indicated, the blue data value is all 1 bits or 111; the green value is all 0 bits or 000, and the red value is given by the binary result 101.

Figure 8:
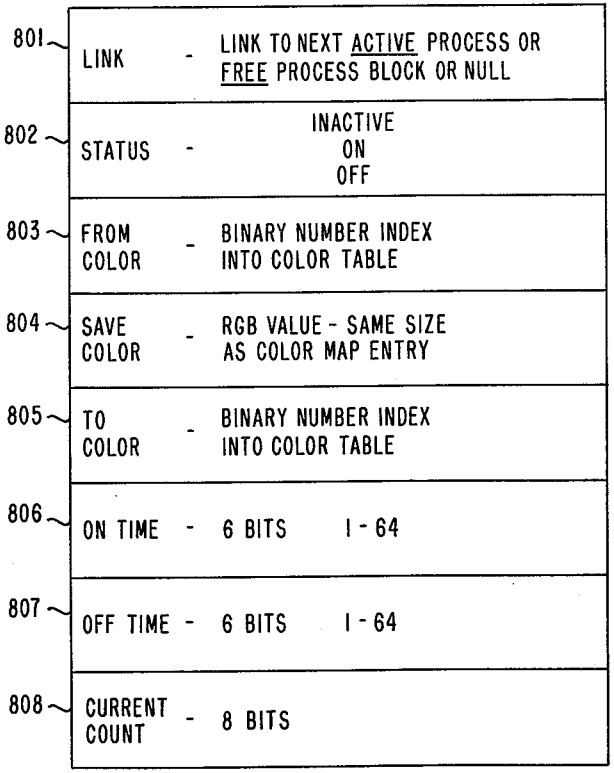

Referring to FIG. 8, there is shown a depiction of a memory block associated with a particular process identifying its parameters. Each time a blink process is initiated, a blink process block must be established in memory which stores the relevant parameters associated with that particular blink process. The first entry 801 in the block stores the LINK value, which is a pointer to the starting address of another blink process block. If the process is actively blinking, then the LINK value will point to the next active process block. If the process is INACTIVE, then the LINK value will point to the next FREE process block.

The second entry 802 in the block stores the current STATUS of the blink process. The status can be either INACTIVE, ON, or OFF (the latter two of which are considered active states).

The third entry 803 is used to store the BLINK-FROM COLOR, which is a binary number index that acts as an index into the color map memory table. This index number is extracted from the operand following opcode representing the color blinking process and does not change throughout the life of the process.

The fourth entry 804 is used to store the SAVE COLOR, which is an RGB value and not a binary index that is periodically copied out of the color map memory table in a manner that will be described subsequently.

The fifth entry 805 is used to store the BLINK-TO COLOR which is a binary number that acts as an index into the color map memory table. This number is also extracted from the operand following the blink process opcode and does not change throughout the life of the process.

The sixth entry 806 stores the ON TIME and the seventh entry 807 stores the OFF TIME, both of which are most conveniently numbers between 1 and 64 that represent time intervals in fractions of a second. These are also extracted from the operand following the blink process opcode and do not change throughout the life of the process.

The eighth entry 808 stores the CURRENT COUNT which is also a number that represents a time interval. This number is updated regularly as the process is executed.

Figure 9:
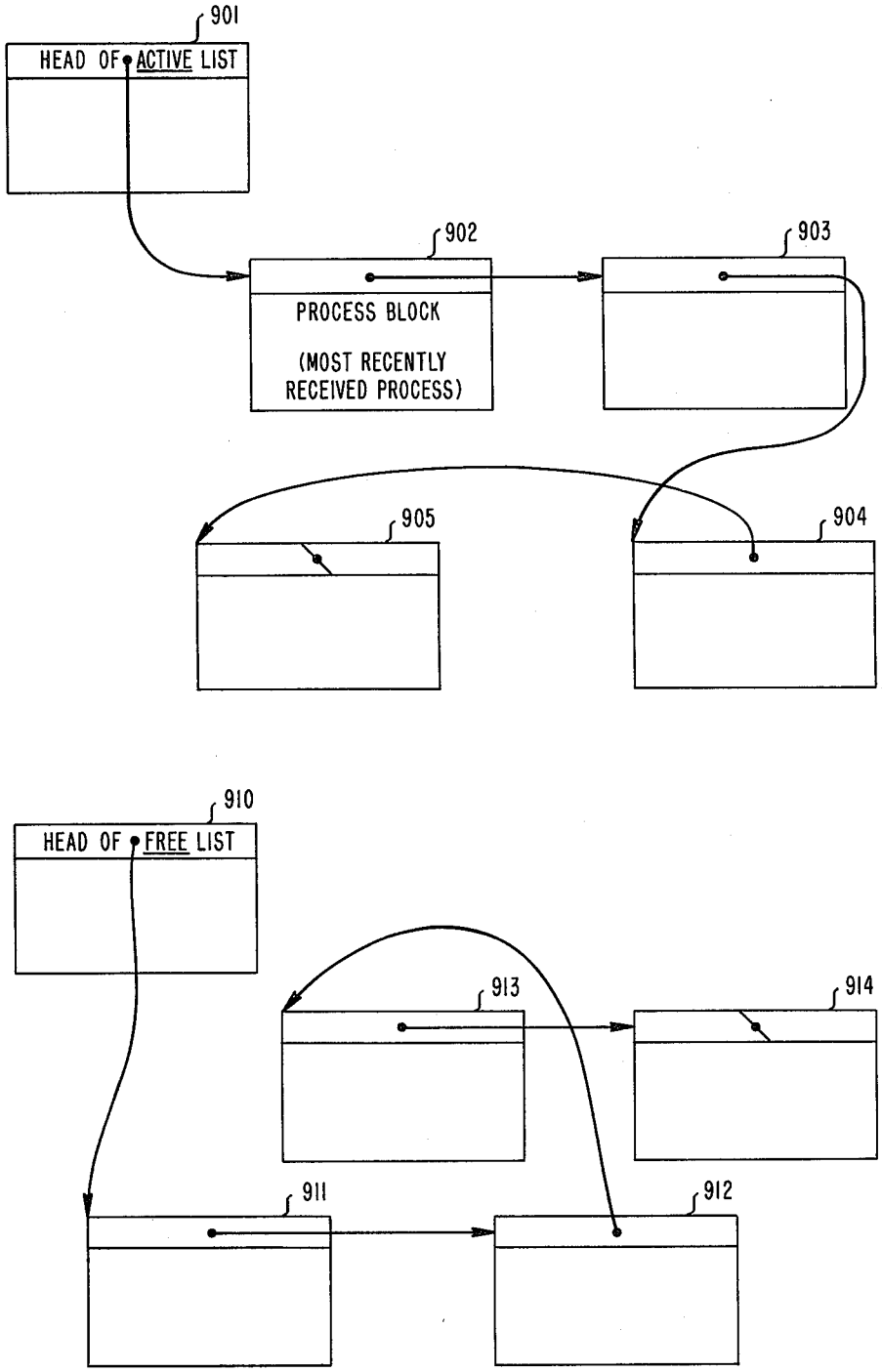

FIG. 9 gives a logical view of how the linked blink process blocks are treated. There are two linked lists kept in memory. The first contains all of the active process blocks and the second contains all of the INACTIVE or free process blocks. The memory occupied by the INACTIVE process blocks is available for use by new blink processes, and hence this list is called the FREE list. The head 901 of the ACTIVE list is a single pointer that contains the address in memory of the beginning of the process block of the most recently received active blink process 902. The LINK entry in this block in turn points to the beginning of the next most recently received active blink process 903, and so on to the beginning of block 904, block 905 through the entire list of process blocks that contain active blink processes. The displaced appearance of the blink process blocks is intended to represent their random appearance in memory. The last process block on the list contains a LINK value NULL indicating the end of the list. The head of the FREE list 910 is a single pointer that contains the address in memory of the beginning of the process block of the first inactive blink process 911. The LINK entry in this block points to the beginning of the next inactive process block 912 and so on to the beginning of block 913, block 914 through the remainder of the inactive process blocks. When the system is initialized, as well as any time that there are no currently active blink processes, all of the available blocks of memory allocated to the blink feature are on the FREE list.

Figure 12:
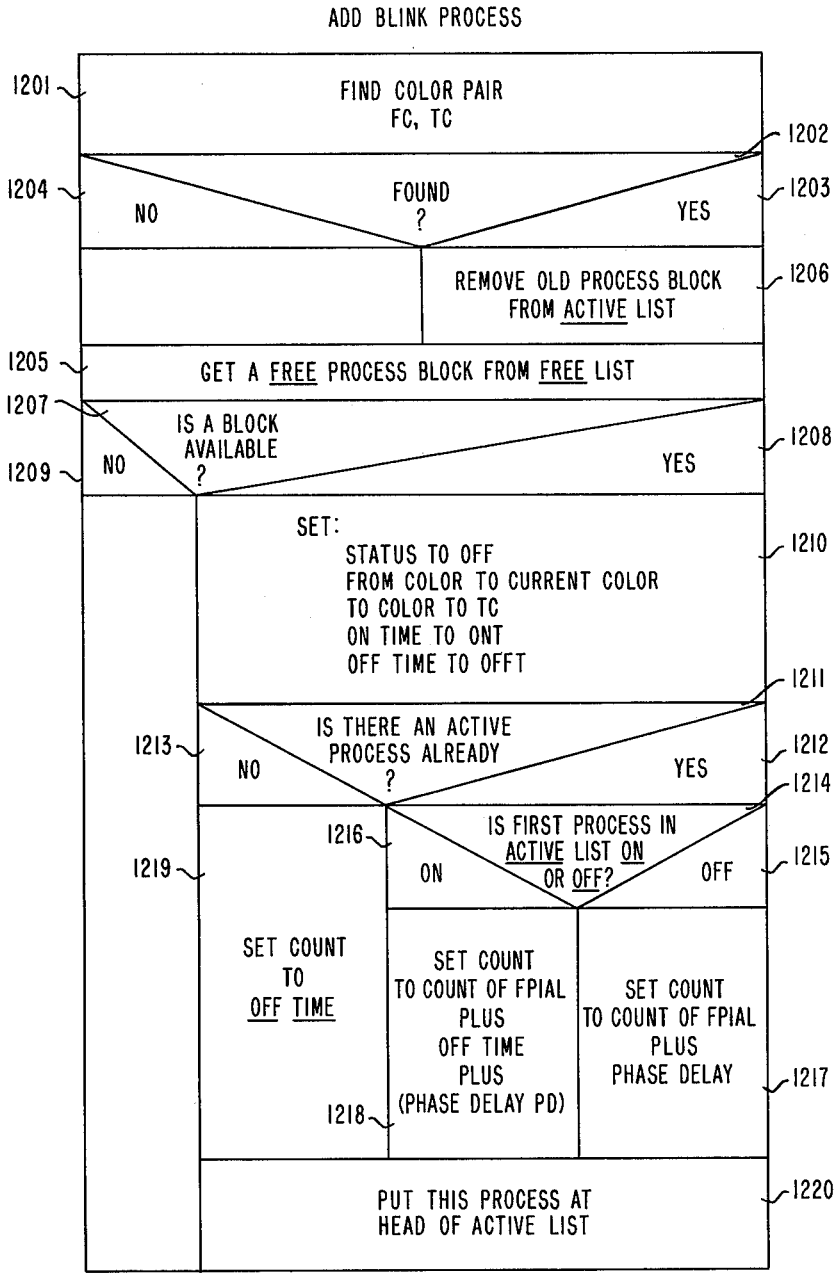

When a new blink process is initiated, more particularly described in the discussion of FIG. 12, the first block in FREE list 911 is made available for its use. When this happens, the head of the FREE list pointer 910 is changed to the address of the beginning of the next free block 912. Also, the head of the ACTIVE list pointer 901 is changed to the address of the beginning of the block 911 just allocated, and the LINK pointer within block 911 is changed to the address of the beginning of what was the most recently received active blink process block 902. The new active process block 911 is then loaded with the relevant parameters of the blink process being defined.

Figure 10:
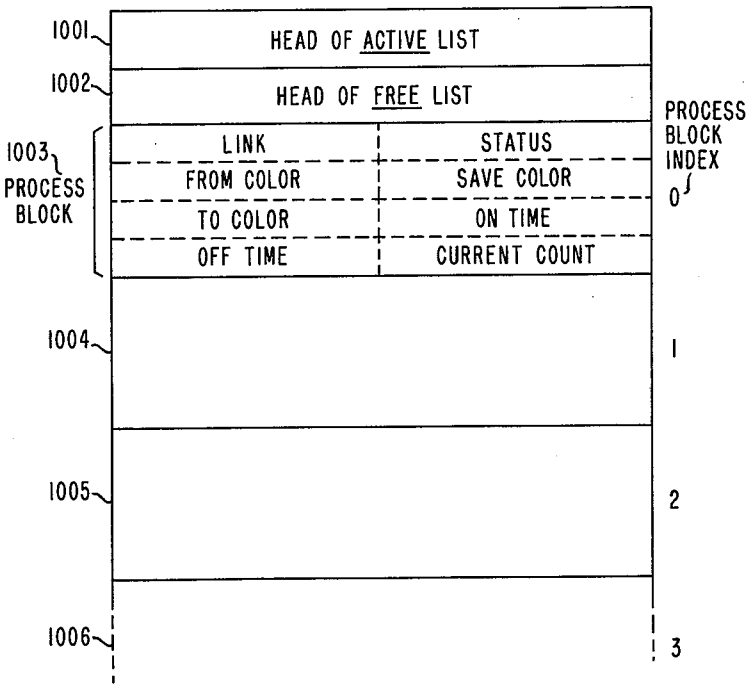
FIGS. 8 through 14 generally depict the present method for poviding multiple processes of color blinking in accordance with the present invention.

FIG. 10 shows the actual organization within memory of blink process blocks. The first entry 1001 and the second entry 1002 store the head of the ACTIVE list pointer and the head of the FREE list pointer, respectively. Process blocks are stored in sequential memory locations 1003 through 1010 or until the capacity allocated within memory 10 is reached. These locations do not necessarily correspond to the order in which the blocks appear on the linked lists.

Figure 11:
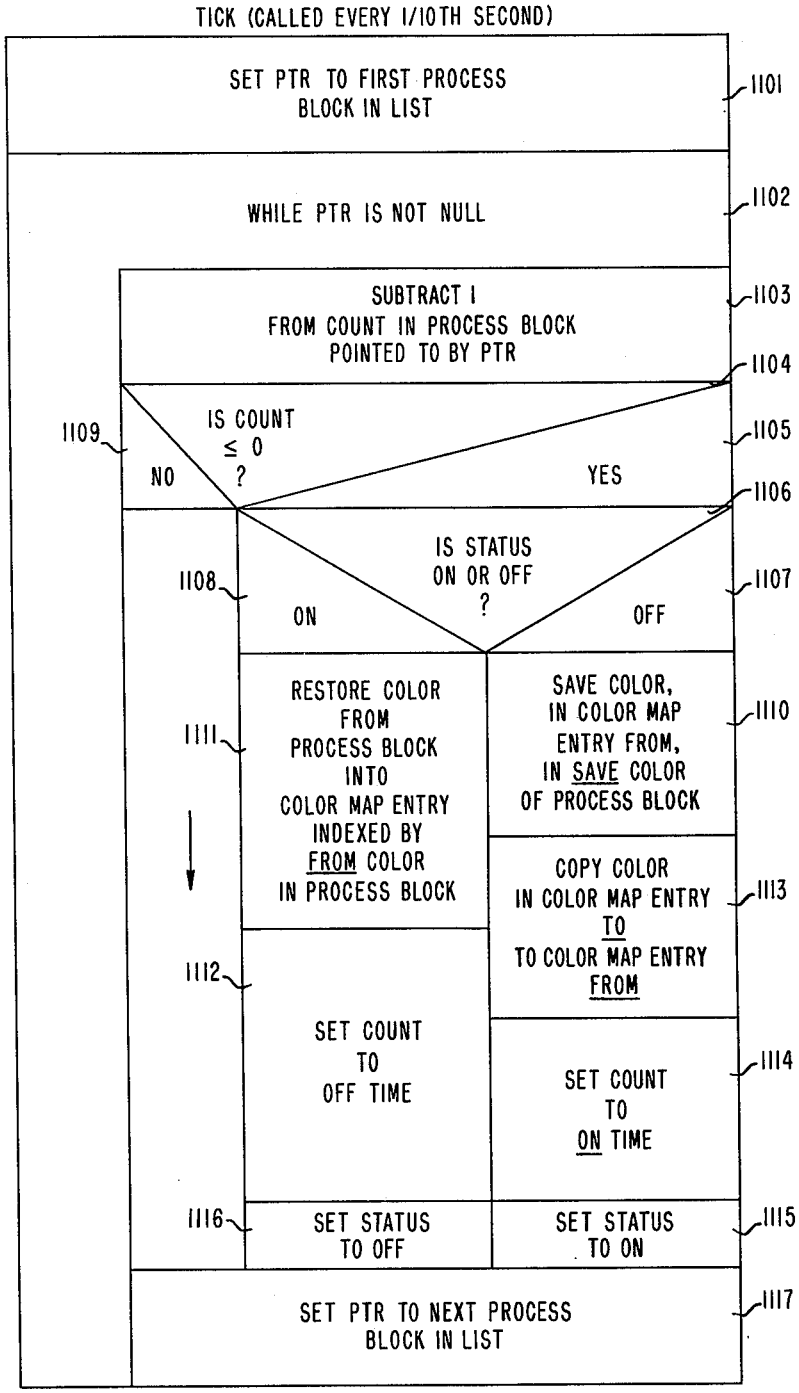

FIG. 11 shows a flow diagram for TICK, the primary blink processing subroutine. TICK is periodically called from a main control program, typically every 1/10th second. This subroutine goes through, examines, and updates each process block (and the color map memory table if necessary) in the ACTIVE list starting with the most recently received blink process block and proceeding to the last.

Activity block 1101 with which the TICK subroutine begins sets the value of an internal status variable PTR to the address stored in the head of the ACTIVE list. (This, as described previously, points to the most recently received active process block.) Activity block 1102 initiates a loop, whose steps comprise blocks 1103 through 1117, that is exited only when it returns a PTR value of NULL. The first step in the loop, activity block 1103, subtracts one from the COUNT of the process block pointed to by PTR. Decision block 1104 then checks the value of COUNT to see if it is equal to or less than zero. If it is not, then control action proceeds through block 1109 (by passing blocks 1106 through 1116) to activity block 1117, which changes PTR to the address stored in the LINK entry of the process block pointed to by PTR or, in other words, the current process block. Control then loops back to activity block 1103 as long as PTR does not have the value NULL. If the COUNT is less than or equal to zero, then control proceeds through block 1105 to decision block 1106. Decision block 1106 checks the value of STATUS in the current process block. If STATUS is on, then control proceeds through block 1108 to activity block 1111. If STATUS off, then control proceeds through block 1107 to activity block 1110.

Activity block 1111 takes the RGB value stored in SAVE COLOR of the current process block and writes it into the color map memory table entry indicated by the index stored in the FROM COLOR entry in that process block. Control then passes to activity block 1112, which sets the COUNT entry of the current process block to the contents of the OFF TIME entry of that block.

Activity block 1116 then sets the STATUS of that process block to OFF before control passes to activity block 1117, whose action has been described previously.

Activity block 1110 copies the RGB value from the color map entry indicated by the index stored in the FROM COLOR entry of the current process block into the SAVE COLOR entry of that process block. Activity block 1113 then copies the RGB value from the color map entry indicated by the index stored in the TO COLOR entry of the current process block into the color map entry indicated by the index stored in the FROM COLOR entry of that process block. Activity block 1114 then sets the COUNT entry to the value stored in the ON entry. Finally Activity block 1115 sets the STATUS entry to ON before control is passed to Activity block 1117, whose action has been described previously.

When the loop is finally exited, that is, when PTR returns the value NULL, the subroutine TICK is complete and control returns to the main control program.

In the previous discussion, the assumption was made that an active process list already had been established.

FIG. 12 is a flow diagram illustrating how one active blink process is added to the active list. Since only one active process is allowed for the ordered pair of FROM COLOR (FC) and TO COLOR (TC), the current list of active process blocks must be searched to determine if a process is active for a given pair. This search is indicated in box 1201. If the ordered pair (FC, TC), is found in the currently active process blocks then that block is made INACTIVE and is removed from the linked list as indicated in box 1206. When box 1205 is encountered an attempt is made to obtain a free process block from the previously described FREE list. At decision box 1207 a check is made to see if a free block was successfully obtained. If no block was obtained then the entire set of possible blocks must have been already allocated to ACTIVE processes and therefore no addition can be made, so the entire process addition procedure is exited.

If a free process block is obtained then it must be initialized as illustrated in box 1210. The new process always begins with a STATUS of OFF which guarantees that the first transition will be OFF-to-ON as previously stated.

The FROM COLOR, TO COLOR and ON and OFF TIME'S are also initialized in box 1210 from data obtained from the operand entered following the blink process opcode.

The phase delay (PD) is an offset from the next OFF-to-ON transition of the most recently received active process (that is, the process of the head of the ACTIVE process list). The head of the ACTIVE list is checked at decision box 1211 in case the list is empty. If the list is empty, then the phase delay does not apply and the CURRENT COUNT in the new process block is set to the OFF TIME as indicated in box 1219.

If an active process exists then two situations arise, either the process is currently ON or OFF. The STATUS of the proces is checked in decision block 1214. If the process is ON then the next OFF-to-ON transition will occure when the CURRENT COUNT reaches the interval of time represented by OFF TIME expires. Therefore, the total time to the next OFF-to-ON transition will be the CURRENT COUNT plus the OFF TIME. In order to synchronize the new process to the most recently received active process, its CURRENT COUNT is set to the time until the next OFF-to-ON transition plus any phase delay as shown in box 1210.

If the last active process has a STATUS of OFF, then the next OFF-to-ON transition will occur at a total time equal to CURRENT COUNT. The new process is therefore synchronized to that transition simply by setting the new process CURRENT COUNT to the CURRENT COUNT of the most recently received process plus any indicated phase delay.

In all cases once the complete process block is initialized, it is added to the active process list as shown in BOX 1220. The ADD NEW PROCESS returns control to the main control program.

Figure 13:
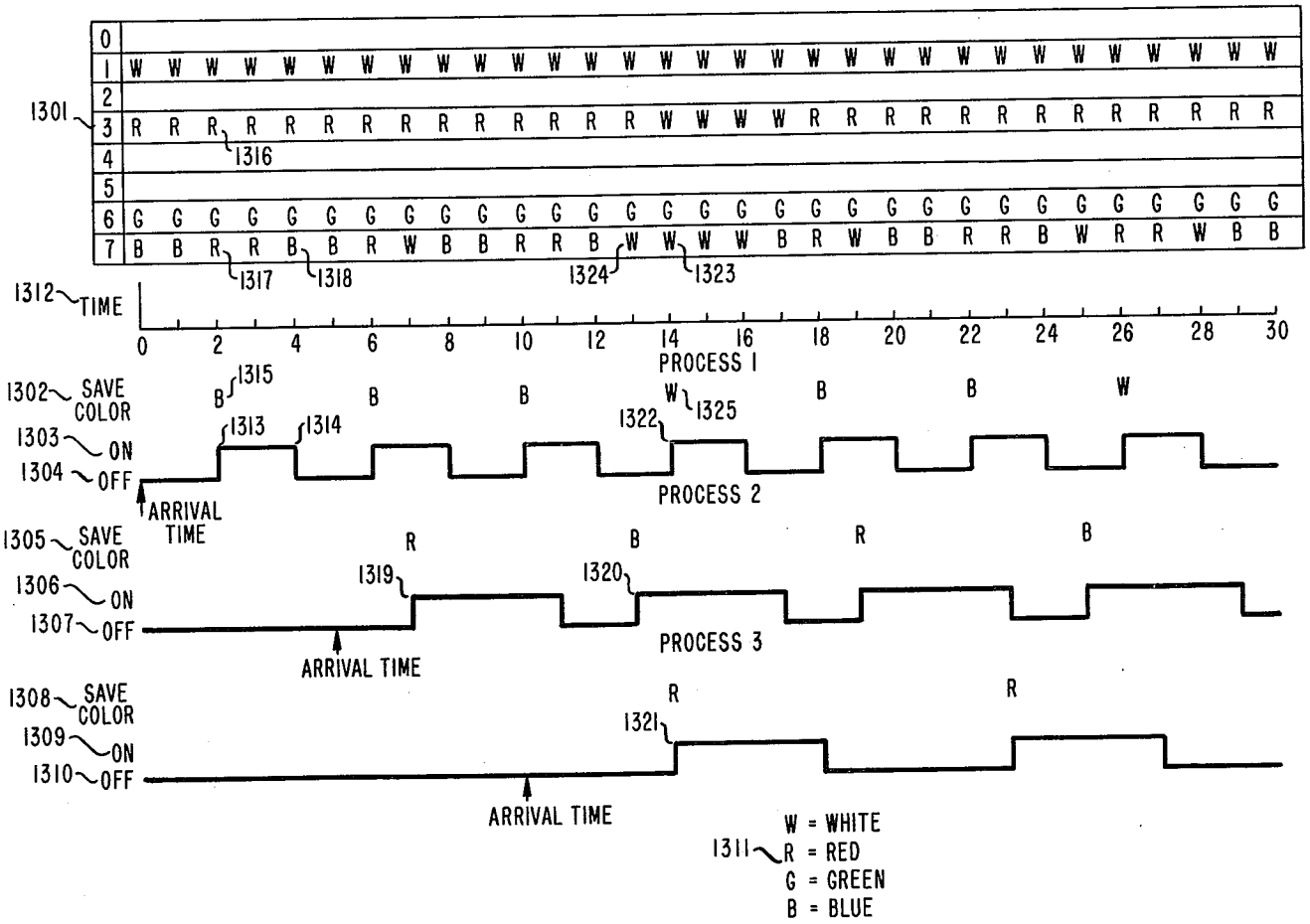

Referring to FIG. 13, exemplary color tables and a timing diagram are illustrated for three active blink processes. Successive representations of an eight entry color table are illustrated in table 1301. Time is indicated by time line 1312. A legend 1311 indicates the assumed color values of color table 1301. The information that was used to establish the three blink processes is as shown in Table 1.

TABLE 1

| | |
|---|---|
| PROCESS 1 | |
| Arrival Time | T = 0 |
| FROM COLOR | 6 |
| TO COLOR | 3 |
| ON TIME | 2 |
| OFF TIME | 2 |
| PHASE DELAY | 3 |
| PROCESS 2 | |
| Arrival Time | T = 5 |
| FROM COLOR | 7 |
| TO COLOR | 1 |
| ON TIME | 4 |
| OFF TIME | 2 |
| PHASE DELAY | 1 |
| PROCESS 3 | |

TABLE 1-continued

| | |
|---|---|
| Arrival Time | T = 10 |
| FROM COLOR | 3 |
| TO COLOR | 7 |
| ON TIME | 4 |
| OFF TIME | 5 |
| PHASE DELAY | 1 |

The color table 1301 at time T=0 contains the color value white in entry 1, the color value red in entry 3, the color value green in entry 6 and the color value blue in entry 7. The other entries may contain color values but are not important in this example.

Process 1 arrives at time T=0 and assuming no active processes already exist, process 1 is activated with a STATUS of OFF (1304). The phase delay that was specified for process 1 is not relevant because no active blink processes existed when the information for process 1 arrived at time T=0.

When process 1 is activated the CURRENT COUNT is set to the OFF TIME which is equal to 2 and therefore an OFF-to-ON transition will occur at time T=2 (1313).

When the OFF-to-ON transition occurs, the color value in the color table indexed by the FROM COLOR, which is equal to 7, is saved in the process block in the SAVE COLOR entry 1302. The color value saved is blue shown by the entry 1315. After the FROM COLOR is saved, the contents of the color table indexed by the TO COLOR is copied to the color table entry indexed by the FROM COLOR. This results in the color value red in entry 3 at 1316 to be copied to entry 7 at 1317.

As a result of this change, any picture elements which were previously displayed using the color value stored in color map entry 7 will immediately change from blue to red. The STATUS of process 1 will be set to ON and the CURRENT COUNT will be set to the ON TIME which is equal to 2. An ON-to-OFF transition will occur at time T=4 referenced by character 1314. At that transition the previously saved color 1315 is restored in the color table at the entry indexed by the FROM COLOR, which is equal to 7, and referenced by character 1318. The STATUS is again set to OFF and the CURRENT COUNT is set to the OFF TIME which is equal to 2. The above sequence is repeated as long as the process is active.

Process 2 arrives at time T=5 which is after process 1 has been activated. Process 2 is started with a STATUS of OFF and must be synchronized with the next OFF-to-ON transition of process 1. Since at time T=5 the STATUS of process 1 is OFF then the time to the next OFF-to-ON transition will be equal to 1, which is the CURRENT COUNT of process 1. A phase delay of 1 was specified with process 2 so the OFF TIME of process 2 is set to the sum of the CURRENT COUNT of process 1 plus the phase delay of process 2, which equals 2. This setting results in the first OFF-to-ON transition occurring at time T=7 referenced by character 1319. Process 2 then begins the color save, copy and restore sequence previously described for process 1.

Process 3 arrives at time T=14 and must be synchronized to process 2. The next OFF-to-ON transition of process 2 occurs at time T=13, and, because of the phase delay of 1, the first OFF-to-ON transition for process 3 will occur at time T=14, referenced by character 1321. As with process 1 and 2, the save, copy and restore sequence will continue for process 3 until changed by either another specification for the same ordered pair of FROM COLOR and TO COLOR or a general resetting procedure.

It should be noted that when colors are copied from one entry in the color table to another that an interaction between processes can result. This is illustrated at time T=13 and T=14. At time T=13, process 2 makes an OFF-to-ON transition referenced by character 1320. The color white is copied to color table entry 7 as referenced by 1324. At time T=14, process 1 makes an OFF-to-ON transition as referenced by 1322. At that transition, the SAVE COLOR, referenced by 1325, is white because of the previous copy operation performed by process 2 at time T=13. This interaction of colors between processes is useful for simple animation and complex blinking sequences.

Figure 14:
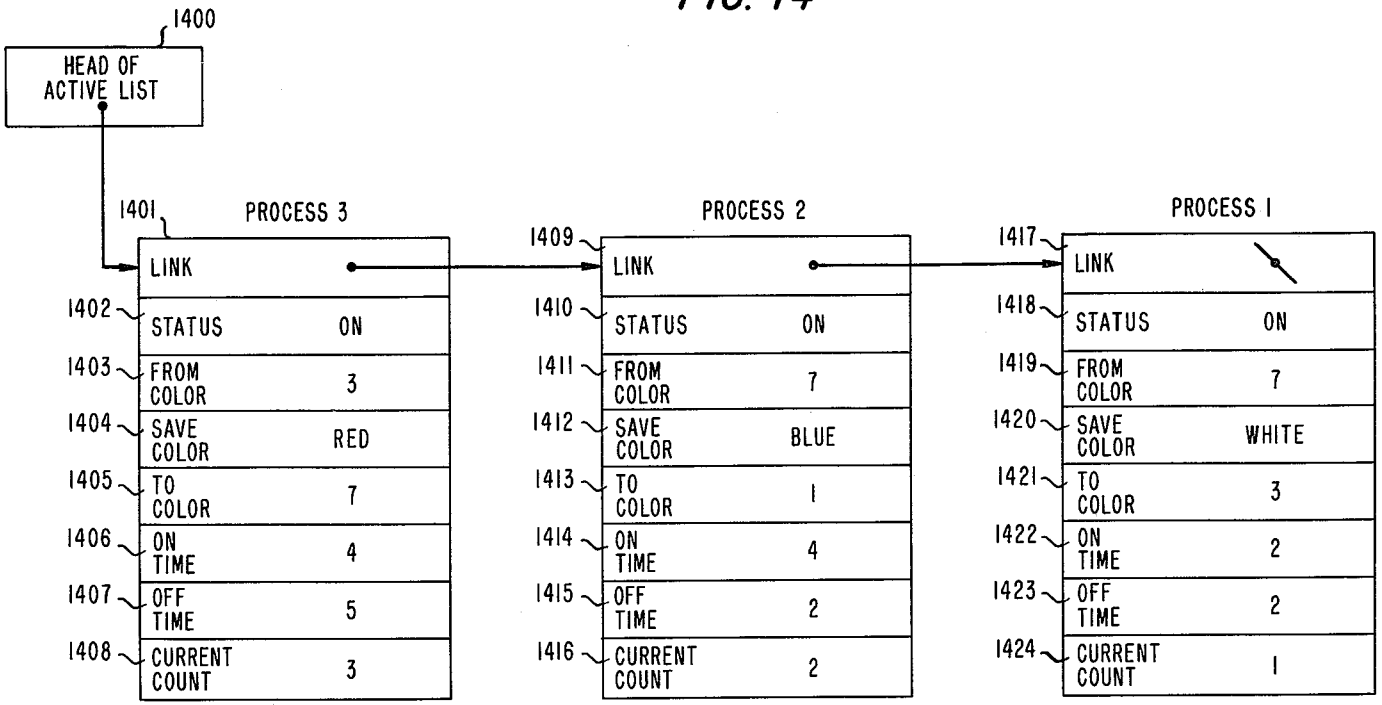

FIG. 14 illustrates the state of the three process blocks at time T=15.

What is claimed is:

1. In a digital image display system:

a memory for storing color data values;

processing means responsive to a predetermined command and data sequence comprising at least one command, the processing means decoding the predetermined command and data sequence, the predetermined command and data sequence selecting one of a plurality of modes of access to color data values, the modes comprising a first mode of access wherein an in-use foreground color is directly specified as a color data value;

a second mode of access wherein the in-use foreground color is specified as an index into the color memory; and a third mode of access wherein the in-use foreground color and an in-use background color are specified as indexes into the color memory; and display means responsive to the processing means, the display means displaying the colors associated with the color data values accessed by the selected mode.

2. A digital image display system comprising:

a color memory for storing color data values;

processing means responsive to predetermined command and data sequences, the processing means, responsive to a first command, selecting a mode of access to the color memory; and responsive to a second command, setting a color data value in the color memory; and display means responsive to the processing means, the display means displaying a color associated with the color data value accessed by the selected mode.

3. A display system as recited in claim 2, wherein the processing means responsive to a second command sets plural color data values in color memory.

4. In a video image display system having a color memory, a method for displaying a color image in a terminal independent manner responsive to commands and data received from a command and data source, the method comprising the steps of:

receiving commands and data from the command and data source;

reading a first command for selecting a mode of access to the color memory, and responsive to data following the first command, selecting the mode of access to the color memory;

reading a second command for setting color data values in the color memory and, responsive to data following the second command, setting the color data values in the color memory, reading a third command for accessing color data values in the color memory, and displaying a color image associated with the color data values accessed by the third command on a video display terminal.

5. A digital image display system comprising:

a color map memory for storing color data values;

processing means for storing color data values in the color map memory and accessing color data values stored in the color map memory, the color data values comprising $2^N/2$ gray level data values equally spaced between black and white, where N is the number of bits in a color entry address of the color map memory and the processing means storing the gray level data values in one half of the color map memory, the color data values further comprising $2^N/2$ hue data values equally spaced about a 360 degree hue circle wherein primary colors red, green, and blue are located in 120 degree relationship to one another and the processing means storing the hue data values in another half of the color map memory, the processing means upon command accessing color data values stored in the color map memory; and display means responsive to the processing means for displaying an image associated with accessed color data values.

6. A digital image display system comprising:

a color map memory for storing color data values;

processing means for storing hue color data values in the color map memory and accessing color data values stored in the color map memory, the hues being equally spaced about a 360 degree hue circle wherein primary colors red, green, and blue are located in 120 degree relationship to one another, and where h is a desired hue color data value, n is a desired number of hue color data values, angle of h is determined by $(j-1)\times 360$ degrees divided by n, where j is an integer between 1 and n, $P_1$ is the closest primary color to the angle of h, $P_2$ is the next closest primary color to the angle of h, and $P_3$ is the furthest primary color from the angle of h, the identity of $P_1$, $P_2$, and $P_3$ being assigned among the primary colors, the processing means setting the binary value of $P_1$ in the color map memory as all 1 bits, setting the binary value of $P_3$ in the color map memory as all 0 bits, and setting in the color map memory the normalized and rounded binary value of $P_2$ resulting from the equation:

$$P_2 = \frac{\sphericalangle h - \sphericalangle P_1}{60^\circ}$$

and upon command accessing color data values stored in the color map memory; and display means responsive to the processing means for displaying an image associated with accessed color data values.

7. A digital image display system comprising:

a color memory for storing color data values;

processing means responsive to a particular command and data sequence providing a blinking of certain picture element data from one particular color specified by the data sequence to another particular color specified by the data sequence by periodically changing color data values in the color memory, multiple color blinking processes being provided responsive to multiple commands, each process subsequent to a first process being in delay relationship to the next previous process; and a display means for displaying the multiple color blinking responsive to the processing means.

8. A display system as recited in claim 7 wherein the processing means determines the time interval each particular color is displayed during a blinking cycle responsive to the command and data sequence.

9. In a digital image display system having a color memory, a method for providing a blinking of certain picture element data from one particular color to another particular color, the color blinking method initiated by the reception of a particular command and data sequence, the color blinking method characterized by the steps of:

specifying multiple color blinking processes, each color blinking process including providing a blinking of certain picture element data from one particular color specified by the data sequence to another particular color specified by the data sequence by periodically changing color data values in the color memory;

specifying a delay interval, if desired, between the processes; and displaying the multiple color blinking.

10. A method for providing color blinking as recited in claim 9 further characterized by the steps of specifying a particular time interval a particular color is displayed during a blinking cycle of a particular color blinking process.

* * * * *

US004439759C1

(12) EX PARTE REEXAMINATION CERTIFICATE (8081st)

United States Patent

Fleming et al.

(10) Number: US 4,439,759 C1

(45) Certificate Issued: Mar. 15, 2011

(54) TERMINAL INDEPENDENT COLOR MEMORY FOR A DIGITAL IMAGE DISPLAY SYSTEM

(75) Inventors: James R. Fleming, Indianapolis, IN (US); William A. Frezza, North Brunswick, NJ (US); Gerald S. Soloway, Holmdel, NJ (US)

(73) Assignee: Lucent Technologies Inc., Murray Hill, NJ (US)

Reexamination Request:
No. 90/008,721, Jul. 24, 2007

Reexamination Certificate for:

| | |
|---|---|
| Patent No.: | **4,439,759** |
| Issued: | **Mar. 27, 1984** |
| Appl. No.: | **06/265,195** |
| Filed: | **May 19, 1981** |

(51) Int. Cl.
*G09G 5/06* (2006.01)
*G09G 5/02* (2006.01)

(52) U.S. Cl. ..... 345/601; 345/467; 345/549

(58) Field of Classification Search ..... None
See application file for complete search history.

(56) References Cited

U.S. PATENT DOCUMENTS 4,213,189 A 7/1980 Mueller et al.

OTHER PUBLICATIONS

Ramtek, "*Programming Manual 9000 Series RM 9100, 9300 Graphic Display System,*" Mar. 1977, 12 pages.

ADI Graphic System Division, User's Guide, Light 50, 35 pages.

AED512 Color Graphics & Imaging Terminal.

AED512 Color Graphics Terminal—Terminal Command Protocol.

Kenneth R. Sloan, Christopher M. Brown, Computer Science Department, "*Color Map Techniques*" Computer Graphics and Image Processing 10, pp. 297–317, 1979.

James D. Foley, James Templeman, Dara Dastyar, *Raster Graphics Extensions to the Graphics Compatibility System (GCS)*, Mar. 1979, pp. 10–72.

ACM, Computer Graphics, A Quarterly Report of SIGGRAPH–ACM, Status Report of the Graphic Standards Planning Committee vol. 13, No. 3, Aug. 1979, 46 pages.

Image I/O Device for Image Processing Color TV Display and TV Camera Input.

*Primary Examiner*—Sam Rimell

(57) ABSTRACT

The present terminal independent color memory for a digital image display system provides for inter-system compatibility, color display systems generally having varying modes of access to color memories, varying color memory capacities, and features such as blinking implemented in varying ways. The data processor (1) of the present system may access color memory (6a) of video controller (6) or color values stored in permanent memory (9) or random access memory (10), responsive to the same command language. The present data processor (1) is also capable of entering color data values comprising color hues and gray levels into color memory for use in a terminal independent manner. Multiple process chained blinking from a particular color to a particular color is also provided by the present processor, the several processes in time-delayed relationship to one another.

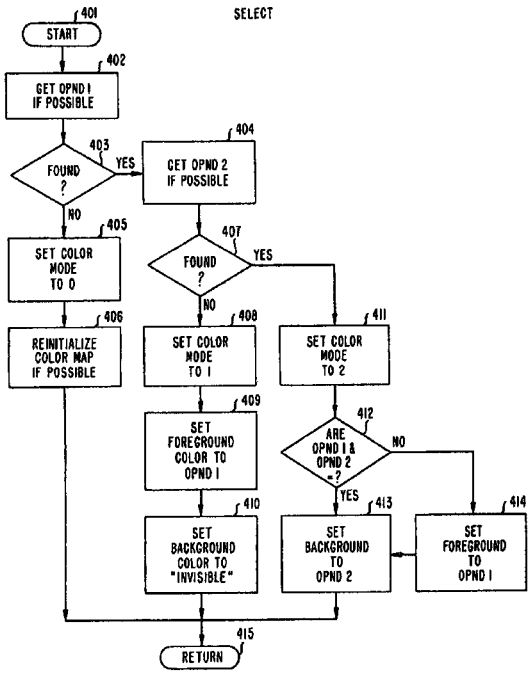

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1-3 is confirmed.
Claim 4 is cancelled.
Claims 5-10 were not reexamined.

* * * * *